US005279752A

United States Patent [19]

Hasegawa et al.

[11] Patent Number: 5,279,752

[45] Date of Patent: Jan. 18, 1994

[54] COMPOSITION FOR LUBRICATING OIL

[75] Inventors: Hiroshi Hasegawa; Umekichi Sasaki; Fujio Komatu; Shigetoshi Ogura; Hideo Yokota, all of Kanagawa, Japan

[73] Assignee: Nippon Oil Co., Ltd., Tokyo

[21] Appl. No.: 939,042

[22] Filed: Sep. 3, 1992

Related U.S. Application Data

[63] Continuation of Ser. No. 482,981.

[30] Foreign Application Priority Data

Feb. 22, 1989 [JP] Japan ..... 1-40278
Nov. 10, 1989 [JP] Japan ..... 1-291065

[51] Int. Cl.[5] ..... C10M 137/04

[52] U.S. Cl. ..... 252/68; 252/32.005; 252/78.5; 252/52 A

[58] Field of Search ..... 252/32.5, 68, 78.5, 252/52 A; 558/203

[56] References Cited

U.S. PATENT DOCUMENTS

| | | | |
|---|---|---|---|
| 2,245,649 | 6/1941 | Caprio | 252/32.5 |
| 2,252,675 | 8/1941 | Prutton | 252/32.5 |
| 2,542,604 | 2/1951 | Weisel . | |
| 2,759,962 | 8/1956 | Zenftman et al. | 252/32.5 |
| 2,866,755 | 12/1958 | Tierney . | |
| 3,287,266 | 11/1966 | Southern et al. | 558/203 |
| 3,583,920 | 6/1971 | Furby | 257/32.5 |
| 3,652,411 | 3/1972 | Commichau . | |
| 4,199,461 | 4/1980 | Olund . | |
| 4,248,726 | 2/1981 | Uchinuma . | |
| 4,431,557 | 2/1984 | Shimizu et al. | 252/52 A |
| 4,711,734 | 12/1987 | Fujita et al. | 252/52 A |
| 4,747,971 | 5/1988 | Erdman | 252/32.5 |
| 4,755,316 | 7/1988 | Magid et al. | 252/52 A |
| 4,800,030 | 1/1989 | Kaneko et al. | 252/32.5 |
| 4,900,463 | 2/1990 | Thomas et al. | 252/68 |

FOREIGN PATENT DOCUMENTS

| | | |
|---|---|---|
| 0336171 | 10/1989 | European Pat. Off. . |
| 1035984 | 7/1966 | United Kingdom . |

OTHER PUBLICATIONS

European Search Report EP 90 30 1844 Dated Sep. 4, 1990; The Hague.

*Primary Examiner*—Jacqueline V. Howard
*Attorney, Agent, or Firm*—Cushman, Darby & Cushman

[57] ABSTRACT

Lubricating oil compositions comprising a base oil and a halogen containing ester of phosphoric acid having a specified structure in an amount in the range of from 0.01 to 5 parts by weight relative to 100 parts by weight of the base oil, and lubricating oil compositions further comprising an epoxy compound in an amount in the range of from 0.1 to 5 parts by weight relative to 100 parts by weight of the base oil.

8 Claims, No Drawings

COMPOSITION FOR LUBRICATING OIL

This is a continuation of application Ser. No. 07/482,981, filed on Feb. 22, 1990, which was now abandoned.

BACKGROUND OF THE INVENTION a) Field of the Invention

The present invention relates to compositions useful as lubricating oil.

b) Description of the Related Art

With respect to the applicational field of the lubricating oil compositions, the recent technical situation and the technical subject which is required to solve, will firstly be described.

Various types of refrigerating machines have heretofore been used. In these refrigerating machines, refrigerating machines which are effected by compressing the vapor of a refrigerant are classified into three types composed of rotary compressor type, reciprocating compressor type and centrifugal compressor type, in accordance with structural type of their compressors.

The rotary refrigerating machines, namely refrigerating machines having a rotary compressor, are widely employed to refrigerators, air conditioners and the like for home use, because they have such a meritorious property that they can be miniaturized and driven with a highly reduced noise.

On the other hand, the reciprocative refrigerating machines are also widely employed as refrigerating machines for car air conditioners and the like, because they can be made as a big one having a large refrigerating capacity and have high mechanical reliability.

As the refrigerants for the refrigerating machines having a type of compressing the vapor of the refrigerant, there are widely used halogenated hydrocarbons typified by trichloromonofluoromethane (CFC-11), dichlorodifluoromethane (CFC-12), monochlorodifluoromethane (HCFC-22), trichlorotrifluoroethane (CFC-113) or the like, hydrocarbons, in which propane is a typical substance, and inorganic gases typified by ammonia, carbon dioxide or the like.

In addition, it has recently been known that 1,1,1,2-tetrafluoroethane (HFC-134a) is also useful as a refrigerant alternative to CFC-12, for avoiding the destruction of the ozone layer in the high altitude atmosphere due to the conventional refrigerants of CFC type.

As lubricating oils for the refrigerating machines using such refrigerants, there are generally used paraffinic mineral oils, naphthenic mineral oils, alkylbenzenes, poly-α-olefines, oils consisting of polyoxyalkylene and/or polyalkylene glycol compounds and a mixture of two or more of these oils, or oils obtained by adding one or more additives to these base oils.

As such additives, there are mainly used antioxidants of phenolic or amino compounds, compounds of benzotriazole type for inactivating metals (Japanese Patent Publication 19352/1985), hydrogen chloride removing agents typified by epoxy compounds (Japanese Patent Publication 42119/1982), load carrying additives of esterified compounds of phosphoric acid typified by triphenyl phosphate and tricresyl phosphate.

The refrigerating machines which are effected by compressing the vapor of the refrigerant under the use of such a lubricating oil, are continuously operated for a very long period of time as refrigerating machines in refrigerators, or are intermittently operated under rigorous conditions as refrigerating machines in car air conditioners accompanied by a high load and the repeated and sudden changes between their stopped state and operated state. Therefore, they must have a high grade safety and reliability in their operations.

According to the recently strengthened tendency of demanding the miniaturization and lightening with regard to almost every kinds of machines, the refrigerating machine have also been forced so as to operate under more rigorous conditions caused by its miniaturized and lightened design.

As a matter of course, the wear resistant properties of the metal portions contacting and sliding each other in such refrigerating machines are very important. For example, when the top ends of the vanes of the rotor or the inner surface of the compressor housing in a rotary compressor are worn, the vapor of the refrigerant leaks through the gap generated between the vane and the housing by the abrasion, and as the result, the compression efficiency of the compressor is reduced. Moreover, when the wear proceeded to an extreme state, the compressor can not continue its mechanically smooth operation, and finaly it becomes entirely impossible to operate by the reason of co-searing phenomenon of the metal portions to be smoothly slided each other.

Conventional lubricating oils become insufficient for giving enough wear resistant properties to the sliding metal portions of the compressor which is designed in accordance with the recent tendency of miniaturizing and lightening the refrigerating machines and is driven under more rigorous operating conditions than those of conventional one.

Additionally, with regard to the lubricating oils for metal processing which is an important application field of lubricating oils, although esters of phosphorous acid which have heretofore been used as extreme pressure agents can increase the lubricational properties of the metal processing oil, the esters have problems in their stabilities such as storage stability, thermal stability and stability for hydrolysis. The shortage in these stabilities can be improved by adding an amine compound to the oil. However, the lubricational properties of the metal processing oil is inversely reduced by the addition of such an amine compound.

Further, phosphate esters and zinc dithiophosphate as the alternatives of the esters of phosphorous acid are excellent in the stabilities, however such alternatives can not give any satisfactory metal processing oil having sufficient lubricational properties.

SUMMARY OF THE INVENTION

As the results of a series of investigational experiments intending to develop a lubricating oil composition which can solve the problems described above, the present inventors have been completed the invention on the basis of such a fortunate finding that the lubricating oil compositions added with an ester of phosphoric acid as an additive, which has a specified chemical structure and contains one or more of halogen atoms in its melecule, have excellent anti-wear properties which could not heretofore be obtained by adding any conventional additive.

The purpose of the present invention is to provide lubricating oil compositions superior in their stabilities and anti-wear properties.

The lubricating oil composition of the present invention comprises a base oil consisting of a mineral oil and/or a synthetic oil and a halogen containing ester of phosphoric acid as an essential component which is expressed by the following general formula:

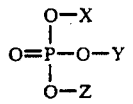

wherein the respective atomic groups of X, Y and Z are the same or different groups each selected from the assemblage composing of alkyl groups having a carbon number of from 1 to 12, modified alkyl groups having one or more oxygen atoms each located between two carbon atoms of the alkyl group and a carbon number of from 1 to 12, phenyl, cresyl, xylyl and halogen substituted groups of the above groups, and the total number of the halogen atoms in the groups of X, Y and Z is in the range of from 1 to 9, in an amount in the range of from 0.01 to 5 parts by weight, preferably in the range of from 0.1 to 2.0 parts by weight, more preferably in the range of from 0.5 to 1.0 part by weight, relative to 100 parts by weight of the base oil. In addition, the lubricating oil composition of the present invention can further comprise an epoxy compound in an amount in the range of from 0.1 to 5.0 parts by weight, preferably in the range of from 0.2 to 2.0 parts by weight, relative to 100 parts by weight of the base oil consisting of a mineral oil and/or a synthetic oil.

DETAILED DESCRIPTION OF THE INVENTION

The contents of the present invention will hereinafter be illustrated in more detail.

As the mineral and synthetic oils for preparing the base oil of the lubricating oil composition in the present invention, any oil can be employed so long as it is used for preparing a base oil of conventional lubricating oils.

As the mineral oil for preparing the base oil, there is used a mineral oil obtained by purifying a relatively heavy fraction got from atmospheric or reduced pressure distillation of a raw petroleum with a purifying procedure composed of a suitable combination of various purification techniques such as deasphalting by a solvent, solvent extraction, hydrogenating decomposition, solvent dewaxing, catalytic dewaxing, sulfuric acid washing, purification by using a terra alba, hydrogenating purification and the like.

Further, as examples of the synthetic oils for preparing the base oil, there may be specifically mentioned normal paraffines; isoparaffines; oligomers of α-olefines such as polybutenes, polyisobutylenes, oligomers of 1-decence and the like; alkylbenzenes such as monoalkylbenzenes, dialkylbenzenes, polyalkylbenzenes and the like; alkylnaphthalenes such as monoalkylnaphthalenes, dialkylnaphthalenes, polyalkylnaphthalenes and the like; diesters of dicarboxylic acids such as di-2-ethylhexyl sebacate, dioctyl adipate, di-iso-decyl adipate, ditridecyl adipate, ditridecyl glutarate and the like; esters of polyhydric alcohols such as trimethylolpropane mono-, di- or tricaprylate, trimethylolpropane mono-, di- or tri-pel-argonate, pentaerythrithol mono-, di-, tr- or tetra-2-ethylhexanoate, pentaerythritol mono-, di-, tr- or tetrapelargonate and the like; polyoxyalkylene glycol compounds such as polyoxyethylene glycols, monoethers of polyoxyethylene glycols, polyoxypropylene glycols, monoethers of polyoxypropylene glycols and the like; polyoxyphenylenes with phenyl terminations; tricresyl phosphates; silicone oils; perfluoropolyoxyalkyl ethers; and the like.

These mineral and synthetic base oils can also be used in combination of two or more.

In the present invention, as the mineral oil employed for preparing the base oil of the lubricating oil composition used as lubricating oil for a refrigerating machine, there can preferably be used a mineral oil which is obtained by purifying, for example, a paraffinic or naphthenic raw petroleum with a purifying procedure composed of a suitable combination of various purification manners such as distillation under a reduced pressure, deasphalting by a solvent, solvent extraction, hydrogenating decomposition, solvent dewaxing, catalytic dewaxing, sulfuric acid washing, purification with a terra alba, hydrogenating purification and the like and has a sulfur content in the range of from 0.05 to 2.0% by weight and an aromotic hydrocarbon content in the range of from 2 to 20% by weight. In addition, as the synthetic oil employed for the same purpose as described above, there can preferably be used synthetic oils such as poly-α-olefines obtained by polymerizing α-olefines, alkylbenzenes and mixtures of alkylbenzenes having one and/or two of straight chain or branched chain alkyl groups of a carbon number in the range of from 5 to 30 as the side chains, and polyoxyalkylene glycol compounds.

Especially preferred base oil in these base oils is a synthetic oil consisting of at least one polyoxyalkylene glycol compound selected from the assemblage composing of [I] polyoxyalkylene glycol compounds expressed by the following general formula:

$$R^2\text{-}(OR^1)_a\text{-}OR^3$$

wherein a is an integer in the range of from 5 to 70, $R^1$ indicates an alkylene group having a carbon number of from 2 to 4, and each of $R^2$ and $R^3$ indicates independently a hydrogen atom or an alkyl group having a carbon number of from 1 to 18; and [II] glycerol ethers of polyoxyalkylene glycols compounds expressed by the following general formula:

$$\begin{array}{l} CH_2\text{-}(OR^4)_b\text{-}OR^7 \\ | \\ CH\text{-}(OR^5)_c\text{-}OR^8 \\ | \\ CH_2\text{-}(OR^6)_d\text{-}OR^9 \end{array}$$

wherein each of b, c and d is an integer selected from 3 to 40 so as to satisfy the equation of $9 \leqq b+c+d \leqq 50$; $R^4$, $R^5$, and $R^6$ are the same or different alkylene groups each having a carbon number of from 2 to 4; and each of $R^7$, $R^8$, and $R^9$ is independently a hydrogen atom or an alkyl group having a carbon number of from 1 to 18.

As examples of the alkylene groups expressed by $R^1$, $R^4$, $R^5$, and $R^6$ and each having a carbon number of from 2 to 4, there may be mentioned, more specifically, the following atomic groups:

ethylene group ($-CH_2CH_2-$), propylene group ($-\underset{\underset{CH_3}{|}}{CH}CH_2-$), trimethylene group ($-CH_2CH_2CH_2-$), -continued butylene group ($-CH(CH_2CH_3)-CH_2-$), 1,2-dimethylethylene group ($-CH(CH_3)-CH(CH_3)-$), 1-methyltrimethylene group ($-CH(CH_3)CH_2CH_2-$), 2-methyltrimethylene group ($-CH_2CH(CH_3)CH_2-$), and tetramethylene group ($-CH_2CH_2CH_2CH_2-$).

In these alkylene groups, the groups of ethylene, propylene, butylene and tetramethylene are preferable.

Further, as examples of the alkyl groups expressed by $R^2$, $R^3$, $R^7$, $R^8$ and $R^9$ and each having a carbon number of from 1 to 18, there may be specifically mentioned alkyl groups of methyl, ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl. In these alkyl groups, the alkyl groups of methyl, ethyl, propyl, butyl, pentyl, hexyl, octyl, decyl and octadecyl are preferable.

In addition, the polyoxyalkylene glycol compounds [I] and the polyoxyalkylene glycol glycerol ether compounds [II] in the present invention may have alkylene groups different each other in their carbon numbers in a molecule. In other words, each polyoxyalkylene chain in a molecule of these polyoxyalkylene glycol compounds [I] and polyoxyalkylene glycol glycerol ether compounds [II] may be a chain obtained by random copolymerization or block copolymerization of oxyalkylene groups different each other in their carbon numbers. However, it is preferred from the view point with regard to the pour point of the resultant lubricating oil for refrigerating machines that, in a molecule of the polyoxyalkylene glycol compounds [I], the ratio of the total number of the oxyethylene groups in the polyoxyalkylene chain relative to the total number (a) of the oxyalkylene groups in the polyoxyalkylene chain has an average value in the range of from 0 to 0.8 and that, in a molecule of the polyoxyalkylene glycol glycerol ether compounds [II], the ratio of the total number of the oxyethylene groups in the polyoxyalkylene chains relative to the total number (b+c+d) of the oxyalkylene groups in the polyoxyalkylene chains has also an average value in the range of from 0 to 0.8.

Further, the polyoxyalkylene glycol compound of [I] or [II] is generally preferable to use in its average molecular weight in the range of from 300 to 4,000, more preferably in the range of from 500 to 3,500.

These mineral and synthetic oils can be employed solely or in a combination of two or more for preparing the base oil of the present invention.

Additionally, the preferable viscosity of these base oils is in the range of from 2.0 to 100 cSt at 40° C.

The composition of the present invention comprises that the base oil described above is added with the halogen containing ester of phosphoric acid which is an essential component for the lubricating oil compositions of the present invention and expressed by the following general formula.

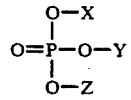

In this formula, the respective groups of X, Y and Z indicate the same or different groups each selected from the assemblage composing of alkyl groups having a carbon number of from 1 to 12, preferably from 3 to 9, modified alkyl groups having one or more oxygen atoms each located between two carbon atoms of the alkyl group and a carbon number of from 1 to 12, preferably from 3 to 9, phenyl, cresyl, xylyl and halogen substituted groups of the above groups.

Further, the total number of the halogen atoms contained in the groups of X, Y and Z is in the range of from 1 to 9, and is preferably in the range of from 2 to 6.

Any similar ester of phosphoric acid not satisfying the above numerical ranges with respects to the carbon number of the alkyl groups and the modified alkyl groups and to the total number of the halogen atoms in the groups of X, Y and Z, is not preferred because the use of such an ester of phosphoric acid leads to a resultant lubricating oil inferior in its lubricating performances.

As examples of the alkyl groups each having a carbon number of from 1 to 12, there may be specifically mentioned alkyl groups of methyl, ethyl, propyl, butyl, pentyl, hexyl, heptyl, octyl, nonyl, decyl, undecyl and dodecyl.

Further, the above modified alkyl group having a carbon number of from 1 to 12 means a group which has one or more oxygen atoms each located between two carbon atoms of the alkyl group. As examples of such modified alkyl groups, there may be mentioned modified alkyl groups having at lest one ether structure and expressed by the following general formula of $R^{10}(OR^{11})_n$ wherein $R^{10}$ is an alkyl group, $R^{11}$ is an alkylene group and n is an integer of 1 or more.

Such an alkyl group or a modified alkyl group for the groups of X, Y and Z may have a straight or branched atomic chain.

In addition, the methyl substituent on the benzene rings of cresyl and xylyl groups for X, Y and Z can be attached to any carbon atom of the benzene rings.

Additionally, as examples of kinds of the halogen atom substituting the hydrogen atom in the groups of X, Y and Z, there may be mentioned atoms of fluorine, chlorine, bromine and iodine, and chlorine is preferred in these halogens.

In the lubricating oil compositions of the present invention, the halogen containing ester of phosphoric acid described above is included in an amount in the range of from 0.01 to 5.0 parts by weight, preferably in the range of from 0.1 to 2.0 parts by weight, more preferably in the range of from 0.5 to 1.0 part by weight, relative to 100 parts by weight of the base oil described hereinbefore.

When the content of the halogen containing ester is not reached to the lower limit of the above range, the resultant lubricating oil is inferior in its lubricating performance. On the other hand, when the content is greater than the upper limit of the range, the lubricating performance of the resulting lubricating oil obtained by adding the ester of phosphoric acid is not increased in proportion to the content of the ester. Therefore, the content of the ester out of the above range is not preferred in the resultant lubricating oil.

In the halogan containing esters of phosphoric acid, there are some esters each of which has the tendency of easily liberating its chlorine atom from the molecule of the ester. In this case, the metals used in the refrigerating system encounter the danger of corrosion due to the liberated chlorine.

Therefore, for further improving the overall properties of the lubricating oil composition of the present invention which is used as the lubricating oil for refrigerating machines, the lubricating oil composition may additionally be mixed with one or more epoxy compounds selected from the assemblage composing of:

(i) epoxy compounds of phenyl glycidyl ether type, (ii) monoesters of epoxidized fatty acids, and (iii) epoxidized vegetable oils.

As the epoxy compounds (i) of phenyl glycidyl ether type mentioned above, there can be exemplified phenyl glycidyl ether and alkylphenyl glycidyl ethers.

With regard to the alkylphenyl glycidyl ethers described above, alkylphenyl group in the ethers is a modified phenyl group with one, two or three alkyl groups each having a carbon number of from 1 to 13. In these alkylphenyl glycidyl ethers, there may be preferred alkylphenyl glycidyl ethers each having an alkyl group of a carbon number in the range of from 4 to 10 on the phenyl group, such as butylphenyl glycidyl ether, pentylphenyl glycidyl ether, hexyphenyl glycidyl ether, heptylphenyl glycidyl ether, octylphenyl glycidyl ether, nonylphenyl glycidyl ether and decylphenyl glycidyl ether.

Further, as the monoesters (ii) of epoxidized fatty acids, there can be exemplified esters formed from fatty acids having a carbon number of from 12 to 20 and various alcohols having a carbon number of from 1 to 8, phenol or alkyl phenols.

Especially, butyl, hexyl, benzyl, cyclohexyl, methoxyethyl, octyl, phenyl or butylphenyl ester of epoxidized stearic acid is preferably used.

Furthermore, as the epoxidized vegetable oils (iii), there can be exemplified an epoxidized vegetable oil obtained by epoxidizing a vegetable oils such as soybean oil, linseed oil, cottonseed oil and the like.

In these epoxy compounds of from (i) to (iii), the epoxy compounds of phenyl glycidyl ether type and monoesters of epoxidized fatty acids are preferable.

The epoxy compounds of phenyl glycidyl ether type are especially preferred in these preferable epoxy compounds of phenyl glycidyl ether type and monoesters of epoxidized fatty acids. Furthermore, phenyl glycidyl ether, butylphenyl glycidyl ether and a mixture of both the ethers are more especially preferred.

When such an epoxy compound is additionally mixed to the lubricating oil compositions of the present invention as an essential additive, the amount of the epoxy compound to be added is in the range of from 0.1 to 5.0 parts by weight, preferably in the range of from 0.2 to 2.0 parts by weight, relative to 100 parts by weight of the base oil in the lubricating oil compositions. When the adding amount of the epoxy compound does not reach to the lower limit of the above range, the effect of preventing the metal corrosion obtained by adding the epoxy compound into the lubricating oil composition of the present invention becomes poor. On the other hand, when the adding amount of the epoxy compound is larger beyond the upper limit of the above range, the abrasion resistant properties and the load carrying properties of the compressor to be lubricated are influenced by adverse effects. Therefore, both the cases are not preferable.

If needed, a variety of additives, which have heretofore been known as additives for lubricating oils, can be added to the lubricating oil compositions of the present invention for further improving the properties of the resultant compositions. As examples of such additives, there may be mentioned antoxidants such as various compounds of phennol type, amine type and the like; purifying detergents or dispersants such as sulfonates, phenolates and salicylates of alkaline earth metals, alkenylsuccinimide, benzylamine and the like; pour point depressants such as polyalkylmethacrylates, polystyrenes, polubutenes, ethylene-propylene copolymers and the like; viscosity-index improving agents such as polyalkylmethacrylates, polyisobutylenes, polystyrenes, ethylene-propylene copolymers and the like; oiliness agents such as fatty acids and their esters, higher alcohols and the like; extreme pressure agents such as various compounds of phosphorus type, chlorine type, sulfur type, organic metal compound type and the like, antirust agents such as sulfonate and carboxylate compounds, esters of sorbitane and the like; metal deactivating agents such as benzotriazol compounds and the like; antifoaming agents such as silicone oils; and other additives such as emulsifying agents, anti-emulsifying agents, bactericides, colorants and the like. The details of such various additives have been disclosed, for example, in "Journal of Japanese Society of Lubricating Oils" 15 (6) or in "Additives for Petroleum Products" edited by Toshio Sakurai and published from Saiwai Book Company.

The lubricating oil compositions of the present invention can be utilized in wide applicational uses such as lubricants used to compressors of refigerating machines for automobile or home use air conditioners, cold and/or freezed storage, automatic vending machines, showcases, cooling apparutuses used in chemical plants, air drying machines and the like; oils for various matal processing such as cutting, grinding, rolling, pressing, drawing, drawing-ironing, forging and the like; engine oils for four cycle and two cycle gasoline engines, diesel engines of land or marine use, gas engines and the like; turbine oils for industrial turbines, gas turbines, marine turbines and the like; gear oils for gears of automobiles, various gears of industrial use, variable speed hydraulic transmissions and the like; oils for actuating hydraulic presses; compressor oils; oils for vacuum pumps; oils for sliding guide way, bearing oils and the like.

EXAMPLES AND COMPARATIVE EXAMPLES

The present invention will hereinafter be illustrated more specifically by using Examples and Comparative Examples.

The following symbols are used in these examples for abbreviating the names of the related compounds:

For additives concerning to the present invention:

TDCPP: Tris-dichloropropyl phosphate,

TCEP: Tris-chloroethyl phosphate,

PGDCPP: Polyoxyalkylene-bis[di(chloroalkyl)] phosphate,

TCPP: Tris-chlorophenyl phosphate, and

PGE: Phenyl glycidyl ether; and

For other additives:

TCP: Tricresyl phosphate,

TPP: Triphenyl phosphate,

DBDS: Dibenzyl disulfide,
Zn-DTP: Zinc dithiophosphate,
CPW: Chlorinated paraffine wax,
DBPC: 2,6-di-t-butyl-p-creson, and
DLHP: Dilauryl hydrogen phosphite.

EXAMPLES 1 TO 9 AND COMPARATIVE EXAMPLES 1 TO 8

With respects to the lubricating oils for refrigerating machine which were used in these Examples and Comparative Examples, their compositions, kinematic viscosities and kinds of additives are shown in Table 1.

In Examples of 1 to 9 related to the present invention, Falex load carrying test, Falex wear test and sealed-tube test were conducted for evaluating the performances of the lubricating oils for refrigerating machine, and the results of these tests are shown in Table 2.

In addition, the same evaluation results as described above with regard to similar lubricating oils using conventional antiwear agents which have heretofore been used in luricating oils for refrigerating machine or for general uses, are also shown in Table 2 for comparison with the lubricating oils according to the present invention.

Falex Load Carrying Test

The searing load in this test was measured in accordance with the method of ASTM D 3233 after the antecedent inuring operation for 5 minutes under conditions of the initial oil temperature of 25° C. and the load of 250 lb.

Falex Wear Test

The amount of wear of the test journal was measured for the operation of 3 hours under the load of 350 lb in accordance with the method of ASTM D 2670 after an antecedent inuring operation for 5 minutes under conditions of the initial oil temperature of 25° C. and the load of 250 lb.

Sealed-tube Test

The equivolume mixture of the lubricating oil to be tested and the refrigerant which was CFC-12 in Examples of 1 to 6 and Comparative Examples of 1 to 6 and was HFC-134a in Examples of 7 to 9 and Comparative Examples of 7 and 8, was placed in a sealed glass tube together with iron and copper catalysts, and the contents in the sealed glass tube were heated at the temperature of 150° C. for 480 hours. Then, the color changes of the lubricating oil and the catalysts were observed and measured visually.

In this connection, the degree of the color change of the lubricating oil tested was classified into twelve grades defining its black-brown state as 11 and colorless state as 0.

Further, with regard to the color changes of the catalysts, it is considered that, when the color changes of the metal catalysts were only in a degree of losing their glosses, the lubricating oil has no problem on its thermal stability, and on the other hand, when the iron catalyst was plated by the copper or was blackened, the lubricating oil is inferior on its thermal stability.

TABLE 1

| Example and Comparative Example | Composition of base oil [part by weight] | | Kinematic viscosity of base oil at 100° C. cSt.* | Additives [part by weight] Halogen containing ester of phosphoric acid | | Epoxy compound | Anti-wear agent | |
|---|---|---|---|---|---|---|---|---|
| Example 1 | Mineral oil | [100] | 4.4 | TDCPP | [1.0] | — | — | |
| Example 2 | Mineral oil | [100] | 4.4 | TCEP | [1.0] | PGE [1.0] | — | |
| Example 3 | Mineral oil | [100] | 4.4 | PGDCPP | [1.0] | — | — | |
| Example 4 | Alkylbenzene | [100] | 5.2 | TDCPP | [1.0] | — | — | |
| Example 5 | Alkylbenzene | [100] | 5.2 | PGDCPP | [1.0] | PGE [1.0] | — | |
| Example 6 | Polyoxypropylene glycol | [100] | 4.3 | TDCPP | [1.0] | — | — | |
| Example 7 | Polyoxypropylene glycol monobutyl ether | [100] | 4.1 | TCEP | [1.0] | — | — | |
| Example 8 | Polyoxyethylenepolyoxypropylene glycol monobutyl ether | [100] | 4.1 | PGDCPP | [1.0] | PGE [1.0] | — | |
| Example 9 | Polyoxypropylene glycol monobutyl ether | [100] | 4.1 | TCPP | [1.0] | — | — | |
| Com. Example 1 | Mineral oil | [100] | 4.4 | — | | — | TCP | [1.0] |
| Com. Example 2 | Alkylbenzene | [100] | 5.2 | — | | — | TPP | [1.0] |
| Com. Example 3 | Polyoxypropylene glycol | [100] | 4.3 | — | | — | TCP | [1.0] |
| Com. Example 4 | Mineral oil | [100] | 4.4 | — | | — | CPW | [1.0] |
| Com. Example 5 | Mineral oil | [100] | 4.4 | — | | PGE [1.0] | DBDS | [0.3] |
| Com. Example 6 | Mineral oil | [100] | 4.4 | — | | PGE [1.0] | Zn-DTP | [0.5] |
| Com. Example 7 | Alkylbenzene | [100] | 5.2 | — | | PGE [1.0] | CPW | [2.0] |
| Com. Example 8 | Polyoxypropylene glycol monobutyl ether | [100] | 4.1 | — | | PGE [1.0] | Zn-DTP | [0.5] |

Note:
*The kinematic viscosity of base oil was measured by the method in accordance with JIS K 2283.

TABLE 2

| Example and Comparative Example | Falex test: Load-Fail Value lb | Falex test: Amount of Pin Wear mg | Sealed-tube test: Refrigerant* | Sealed-tube test: Color change of test oil | Sealed-tube test: External appearance of catalyst |
|---|---|---|---|---|---|
| Example 1 | 1,550 | 2.9 | 12 | 2 | Gloss is reduced. |
| Example 2 | 1,500 | 3.3 | 12 | 2 | No change |
| Example 3 | 1,450 | 3.5 | 12 | 2 | Gloss is reduced. |
| Example 4 | 1,500 | 3.0 | 12 | 1 | Gloss is reduced. |
| Example 5 | 1,100 | 3.6 | 12 | 1 | No change |
| Example 6 | 1,100 | 4.2 | 12 | 0 | No change |
| Example 7 | 1,050 | 4.5 | 134 | 0 | No change |

TABLE 2-continued

| Example and Comparative Example | Falex test | | Sealed-tube test | | |
|---|---|---|---|---|---|
| | Load-Fail Value lb | Amount of Pin Wear mg | Refrig-erant* | Color change of test oil | External appearance of catalyst |
| Example 8 | 1,000 | 4.7 | 134 | 0 | No change |
| Example 9 | 1,050 | 4.3 | 134 | 0 | No change |
| Comparative Example 1 | 1,250 | 15.1 | 12 | 2 | Gloss is reduced. |
| Comparative Example 2 | 1,250 | 16.5 | 12 | 1 | Gloss is reduced. |
| Comparative Example 3 | 800 | 17.7 | 12 | 0 | No change |
| Comparative Example 4 | 1,550 | 5.8 | 12 | 11 | Blackened |
| Comparative Example 5 | 1,450 | 4.9 | 12 | 11 | Blackened |
| Comparative Example 6 | 1,400 | 7.2 | 12 | 11 | Blackened |
| Comparative Example 7 | 1,500 | 6.2 | 134 | 11 | Blackened |
| Comparative Example 8 | 1,100 | 9.5 | 134 | 11 | Blackened |

Note:
*12 indicates CFC-12 and 134 indicates HFC-134a.

As indicated by the results of Examples of 1 to 9 described in Table 2, the lubricating oils for refrigerating machines according to the present invention are higher at a value in the range of from 200 to 300 lb in the searing loads of Falex test and are also reduced to a value of from one fourth to one fifth in the amounts of wears of Falex test, in comparison with those of the lubricating oils of Comparative Examples 1 to 3 in each of which an antiwear agent used to conventional lubricating oils for refrigerating machine was added with. In addition, it is similarly recognized that the lubricating oils for refrigerating machines according to the present invention exhibit sufficient thermal stability in the sealed-tube tests and are also superior than the lubricating oils using the conventional antiwear agents. On the other hand, as shown by the results of Comparative Examples of 4 to 8, the lubricating oils added with the antiwear agents which have heretofore been used to various kinds of lubricating oil, exhibit the nearly equal performances in both Falex tests with those of the lubricating oils for refrigerating machine according to the present invention. However, in the thermal stability by using the sealed-tube test, the lubricating oils added with such conventional antiwear agents are remarkably inferior as if they can not actually be used in comparison with the lubricating oils according to the present invention.

Table 3. Falex wear test and another thermal stability test were conducted for evaluating the performances of the cutting oil of Example 10 related to the present invention, and results of these tests are shown in Table 3. In addition, the same evaluation results as described above with regard to the similar cutting oils using conventional antiwear agents which have heretofore been used to lubricating oils for various applicational uses, are also shown in Table 3 for comparison with the lubricating oil according to the present invention.

Falex Wear Test

The amount of wear of the test journal (SUS 304) was measured for the operation of 30 minutes under the load of 1,300 lb in accordance with the method of ASTM D 2670 after an antecedent inuring operation of 25° C. and the load of 250 lb.

Thermal Stability Test

A sample of the cutting oil was placed in a test tube and was maintained for 24 hours in a thermostatic air bath at the temperature of 120° C., and then the cutting oil was observed visually.

In Table 3, the results of the observation are indicated in the way that no sludge generated is ○, some sludge generated is Δ, and a large amount of sludge generated is ×.

TABLE 3

| Example and Comparative Example | Base oil (100 parts by wt.) | | Additive (amount in part by weight) | | | Amount of Pin Wear in Falex test (mg) | Thermal stability |
|---|---|---|---|---|---|---|---|
| | Kind | Kinematic* viscosity at 40° C., cSt. | Halogen containing ester of phosphoric acid | Anti-wear agent | Other additive | | |
| Example 10 | Mineral oil | 25 | TDCPP | — | CPW (29)<br>Lard sulfide (32)<br>DBPC (0.5) | 43.5 | |
| Comparative Example 9 | " | " | — | DLHP (1.6) | CPW (29)<br>Lard sulfide (32)<br>DBPC (0.5) | 42.8 | X |
| Comparative Example 10 | " | " | — | Zn-DTP | CPW (29)<br>Lard sulfide (32)<br>DBPC (0.5) | 62.3 | Δ |
| Comparative Example 11 | " | " | — | DLHP | CPW (29)<br>Lard sulfide (32)<br>DBPC (0.5)<br>Oleyl amine (1.0) | 62.0 | |

Note:
*The kinematic viscosity was measured by the method according to JIS K 2283.

EXAMPLE 10 AND COMPARATIVE EXAMPLES 9 to 11

With regard to the cutting oils used in these Example and Comparative Examples, their compositions, kinematic viscosities and kinds of additives are shown in As shown by the results in Table 3, the cutting oil according to the present invention is superior in thermal stability by comparison to the cutting oil of Comparative Example 9 which was added with DLHP as a phosphite compound, and is also superior in antiwear property by comparison to the cutting oil of Comparative Example 10 which was added with Zn-DTP. In addition, the cutting oil of Example 11 which was prepared by further adding an amine compound to the cutting oil composition of Comparative Example 9, is improved in thermal stability, but is inferior in antiwear property.

As clearly shown by the hereinabove description and results of Examples and Comparative Examples, the lubricating oil compositions according to the present invention are superior in performance of reducing the wear of metals and thermal stability.

We claim:

1. A method for lubricating refrigerating machines which comprises (1) preparing a lubricating oil composition comprising:

(a) a base oil which is one more compounds selected from the groups consisting of a mineral oil and synthetic oil; and (b) a halogen-containing ester of phosphoric acid of the following general formula:

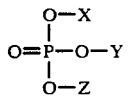

wherein X, Y and Z are the same or different groups, and are each selected for the group consisting of alkyl groups having a carbon number of from 1 to 12, modified alkyl groups having one or more oxygen atoms each located between two carbon atoms of the alkyl and a carbon number of from 1 to 12, phenyl, cresyl, xylyl, and halogen substituted groups of the above groups, wherein the total number of halogen atoms in the groups X, Y and Z is in the range from 2 to 6:

wherein the halogen-containing ester of phosphoric acid is present in an amount of 0.01 to 5 parts by weight, relative to 100 parts by weight of the base oil, (2) pouring said lubricating oil composition into a portion to be lubricated in the refrigerating machines, and (3) lubricating metal portions contacting and sliding with each other in the refrigerating machines with said lubricating oil composition, said refrigerating machines being operated in the presence of refrigerants.

2. A method according to claim 1 in which said base oil is a purified mineral oil having a sulfur content in the range of from 0.05 to 2.0% by weight and an aromatic hydrocarbon content in the range of from 2 to 20% by weight.

3. A method according to claim 1 in which said base oil is a synthetic oil of polyoxyalkylene glycol compounds.

4. A method according to claim 1 in which said base oil is a synthetic oil consisting of a poly-a-olefin, alkylbenzenes monosubstituted and/or disubstituted with straight chain alkyl groups having a carbon number of from 5 to 30 or alkylbenzenes monosubstituted and/or disubstituted with branched chain alkyl groups having a carbon number of from 5 to 30.

5. A method according to claim 1, 2, 3 or 4 in which said base oil is a mixture consisting of two or more oils selected from the group consisting of mineral oils and synthetic oils.

6. A method according to claim 1, 2, 3 or 4 in which said lubricating oil composition further comprises an epoxy compound which is selected from the group consisting of:

(i) epoxy compounds of the phenyl glycidyl ether type, (ii) monoesters of epoxidized fatty acids, and (iii) epoxidized vegetable oils in an amount in the range from 0.1 to 5.0 parts by weight relative to 100 parts by weight of the base oil.

7. A method according to claim 5 in which said lubricating oil composition further comprises an epoxy compound which is selected from the group consisting of:

(i) epoxy compounds of the phenyl glycidyl ether type, (ii) monoesters of epoxidized fatty acids, and (iii) epoxidized vegetable oils in an amount in the range from 0.1 to 5.0 parts by weight relative to 100 parts by weight of the base oil.

8. A method according to claim 3, wherein said polyoxyalkylene glycol base oil is a synthetic oil consisting of at least one polyoxyalkylene glycol selected from the group consisting of:

(I) polyoxyalkylene glycols of the general formula:

$$R^2-(OR^1)_a-OR^3$$

wherein a is an integer in the range from 5 to 70, $R^1$ is a $C_2$ to $C_4$ alkylene group, and each of $R^2$ and $R^3$ is independently selected from a hydrogen atom and a $C_1$ to $C_{18}$ alkyl group; and (II) glycerol ethers of polyoxyalkylene glycols of the general formula:

$$\begin{array}{l} CH_2-(OR^4)_b-OR^7 \\ | \\ CH-(OR^5)_c-OR^8 \\ | \\ CH_2-(OR^6)_d-OR^9 \end{array}$$

wherein each of b, c and d is an integer independently selected from integers in the range 3 to 40, so as to satisfy the equation $9 \leqq b+c+d \geqq 50$, and each of $R^4$, $R^5$ and $R^6$ is independently a $C_2$ to $C_4$ alkylene group, and each of $R^7$, $R^8$ and $R^9$ is independently selected from a hydrogen atom and a $C_1$ to $C_{18}$ alkyl group.

* * * * *